US005470206A

United States Patent [19]

Breslin

[11] Patent Number: 5,470,206

[45] Date of Patent: Nov. 28, 1995

[54] PNEUMATICALLY POWERED SUBMERSIBLE FLUIDS PUMP WITH CASING ACTIVATOR

[76] Inventor: Michael K. Breslin, 149 Shelley Dr., Mill Valley, Calif. 94941

[21] Appl. No.: 325,856

[22] Filed: Oct. 19, 1994

[51] Int. Cl.[6] ..... F04F 1/06

[52] U.S. Cl. ..... 417/131; 417/143

[58] Field of Search ..... 417/131, 134, 417/61, 119, 143, 145, 337

[56] References Cited

U.S. PATENT DOCUMENTS

| | | | |
|---|---|---|---|
| 122,950 | 1/1872 | Lytle | 417/131 |
| 561,268 | 6/1896 | Merrill | 417/131 |
| 4,181,470 | 1/1980 | Gillett | 417/131 |
| 4,600,363 | 7/1986 | Ise . | |
| 4,606,703 | 8/1986 | Baines . | |
| 4,655,692 | 4/1987 | Ise . | |
| 4,705,462 | 11/1987 | Balembois . | |
| 4,971,531 | 11/1990 | Aikioniemi . | |
| 4,990,060 | 2/1991 | Cheng-Chung . | |
| 5,004,405 | 4/1991 | Breslin | 417/131 |
| 5,031,402 | 7/1991 | Klaeger . | |
| 5,059,954 | 10/1991 | Beldham . | |
| 5,141,404 | 8/1992 | Newcomer . | |
| 5,174,722 | 12/1992 | Lybecker . | |
| 5,174,731 | 12/1992 | Korver . | |
| 5,186,611 | 2/1993 | Frandsen . | |
| 5,201,175 | 4/1993 | Kahrs . | |
| 5,218,986 | 6/1993 | Farwell . | |
| 5,326,458 | 7/1994 | Johnson . | |
| 5,358,037 | 10/1994 | Edwards . | |
| 5,358,038 | 10/1994 | Edwards . | |

FOREIGN PATENT DOCUMENTS

| | | | |
|---|---|---|---|
| 706562 | 12/1979 | U.S.S.R. | 417/337 |
| 973944 | 11/1982 | U.S.S.R. | 417/145 |
| 189009 | 1/1922 | United Kingdom | 417/134 |

*Primary Examiner*—Richard A. Bertsch
*Assistant Examiner*—Ted Kim
*Attorney, Agent, or Firm*—Townsend and Townsend Khourie and Crew

[57] ABSTRACT

A pump, submerged in a fluid in a pump or well, has a buoyant outer, enclosing casing. Communicated to the casing are a conduit to supplying compressed air to the casing, a conduit for carrying the exhausted air away from the casing, an inlet and check valve for permitting entry of fluid into the casing, and an outlet and a check valve connected to discharge piping for carrying fluid away from the casing. The outer casing slides vertically relative to the discharge piping and is supported by the discharge piping for vertical movement between upper and lower stops where the casing actuates an air exhaust valve and a compressed air inlet valve. When the buoyant casing is in the upper position, air within the casing can escape through the open chamber air exhaust valve and compressed air entry is blocked to the casing through the closed compressed air inlet valve. When the casing is in the lower position, air within the casing is blocked from escape by the closed chamber air exhaust valve and compressed air entry enters the casing through the open compressed air inlet valve. Fluid to be pumped, entering and exiting the casing, changes the casing buoyancy, and this buoyancy acts with full force, opening and closing the valves to cycle the pump between the upper and lower position, causing pumping to occur.

28 Claims, 14 Drawing Sheets

PNEUMATICALLY POWERED SUBMERSIBLE FLUIDS PUMP WITH CASING ACTIVATOR

FIELD OF THE INVENTION

This invention relates to pumps, specifically to a submersible pump with integrated controls, powered by compressed air.

BACKGROUND OF THE INVENTION AND PRIOR ART

Proposals have been made in the past to provide a pumping system which would automatically sense the presence of liquid and then pump the sensed liquid from one location to another. Such a pump could be used in draining sumps or pumping from a well.

One typical device, which has been in use for years is the combining of an air-driven double diaphragm pump and a pneumatic bubbler/air valve. For example, this kind of system is available from Air Pump Company of Grand Blanc, Mich., USA and is sold under the trademark APCO.

Systems of these types require the use of a double diaphragm pump, these pumps being generally larger than 10 inches in diameter. The double diaphragm pump is used to draw under vacuum fluids from one location and push them to another. This type of system is limited since it can only draw fluid up under a vacuum from about 25 feet depth. To reach greater depths, the pump must be lowered into a rather large well, sump or opening. Additionally, the nature of the double diaphragm pump's mechanical action makes it an inefficient pump to use.

Another type of system utilizes internal controls to operate pneumatic valves and pressurize and exhaust the pump based upon the fullness of the pump. An example of such a system is shown in U.S. Pat. No. 4,467,831 to French, issued Aug. 28, 1984.

This system utilizes a displacer to load and unload spring-loaded opposing poppets and thus cause the pump body to pressurize and exhaust. These types of systems have several inherent defects which make the use of the system fraught with maintenance and control problems. A displacer weight, spring tension and friction acting on upper and lower poppets which seat in O-rings must be maintained in balance. Too much pressure on either the lower or the upper poppet can cause the poppet to jam into the O-ring and "freeze" the pump. If the pressure is not great enough on the upper poppet, the spring tension can lift it off its seat and cause air to constantly stream into the pump and out its exhaust.

In practice the pressure range in which this design can operate when the pump must operate within a 4-inch well casing or smaller spans about 40 psi. If the pressure to be used falls or rises outside of this range, the internal mechanism of the pump must be adjusted to accommodate such operation or the pump will fail to operate. This can be a severe problem if the pressure to the pump fluctuates or the head against which the fluid is being pumped increases.

In addition, when the pump is introducing pressurized air into the pump chamber to push out fluid, some of this air bleeds off out the exhaust. This causes a loss of energy. If the pump is constructed so that fluid enters through a check valve at the base of the pump, a fast influx of fluid can remove weight from the displacer and cause the poppets to shift. When this happens, pressurized air forces the fluid out of the pump, moving the displacer down and reseating the poppets. This action is repeated rapidly and a "stuttering" or "quick cycle" is developed. When this condition is reached, the pump rate and efficiency decreases dramatically.

In addition, the friction of the O-rings against the poppets can change if the chemicals which are being pumped cause the O-rings to become lubricated or swell. This can cause the valve mechanism to shift too soon or not at all. This design is also adversely affected by the flow of fluid into and out of the pump. Such flow creates drag on the displacer and causes premature opening and closing of air valves. This can cause a stuttering-type of failure.

Another type of system is generally described in U.S. Pat. No. 5,004,405 issued to Breslin on Apr. 2, 1991 entitled PNEUMATICALLY POWERED SUBMERSIBLE FLUIDS PUMPS WITH INTEGRATED CONTROLS. One example is that pump manufactured by Clean Environment Equipment of Oakland, Calif. and sold under the trademark AutoPump. Essentially the same pump is also manufactured by QED of Ann Arbor, Mich. and Ejector Systems in Addison, Ill.

These types of systems utilize a moving float inside the pump which travels with the fluid in the pump. When the pump is full, the float and the fluid are at their uppermost point of travel and the buoyant float forces a control rod upwards, causing a pneumatic valve to switch. The pneumatic valve allows pressurized air into the pump, forcing the water out. When the pump is empty, the float and the fluid are at their lowermost point in the pump. As the fluid level decreases, the float pulls the same control rod downwards, shifting the pneumatic valve to exhaust the pump and allow it to fill again.

This pump design works well. However, the float is an expensive part of the pump and is contained inside the pump casing. When the float is inside the pump casing, it occupies space and thus eliminates volume which might otherwise be used for pumping.

OBJECTS AND ADVANTAGES OF THE INVENTION

Accordingly, this invention does not require and internal float so dirt the builds up on the inside of the pump does not block the activating mechanism. This invention also does not require a displacer, so the quick inrush or discharge of fluids does not prematurely trigger the air valve mechanism. An additional advantage to not requiring a float or displacer is that the internal volume of the pump casing is not diminished by the presence of a float or displacer and thus is more efficient. The invention can operate over a wide range of pressures and does not need to be adjusted if the pressure against which it is pumping varies. The invention can be constructed of materials impervious to chemicals and thus the action will not be affected by harsh chemicals or solvents.

Positive opening and closing of the respective first exhaust valve and second compressed air inlet valve is assured by the relatively large changes of buoyant forces acting on the casing. These valves are actuated by a force equivalent to the maximum force of the displacement of the entire mass of the fluid being pumped from the buoyant pump chamber. There is no restriction to valve actuation by the displacement of a float or other member inside a pump. Further, this pump is an efficient pump that it utilizes almost the entire internal volume of the buoyant pump casing as pumping volume is disclosed.

Thus, an apparatus and a method for pumping fluid uses the exterior casing of the pump as a buoyant member to trip a pneumatic valves to alternately pressurizes and exhausts the buoyant pump chamber. A pump system that can operate regardless of debris buildup inside the pump canister is set forth.

Advantages of this invention over the prior art include the disclosure of a reliable and versatile pump which can be used without adjustment due to pressure changes or the effects of chemical fumes from the fluids it is pumping. It also has no internal sensing mechanism that can be affected by pressure of the compressed air.

Other features, objects and advantages of this invention will become more apparent after referring to the following specification and attached drawings.

SUMMARY OF THE INVENTION

In accordance with the invention, a pump, submerged in a fluid in a sump or well, has a buoyant outer and enclosed casing. Communicated to the casing are a conduit to supply compressed air to the casing, a conduit to carry the exhausted air away from the casing, an inlet and check valve to permit entry of fluid into the casing, and an outlet and check valve connected to discharge piping to carry fluid away from the casing. The outer casing of the pump slides vertically relative to the discharge piping and is supported by the discharge piping for vertical movement between upper and lower stops where the casing actuates an air exhaust valve and compressed air inlet valve. When the buoyant casing is in the upper position, air within the casing can escape through the open chamber air exhaust valve and compressed air entry is blocked to the casing through the closed compressed air inlet valve. When the buoyant casing is in the lower position, air within the casing is blocked from escape by the closed chamber air exhaust valve and compressed air entry enters the casing through the open compressed air inlet valve. Fluid to be pumped, entering and exiting the casing, changes the casing buoyancy, and this buoyancy acts with full force opening and closing the valves to cycle the pump between the upper and lower position, causing pumping to occur.

In operation, when the buoyant casing is in the upper position, fluid enters the casing via force of gravity through the inlet and check valve. Air is thereby pushed out of the open chamber air exhaust valve as the fluid fills the pump chamber while the closed compressed air inlet valve prevents the entry of compressed air. When the fluid rises inside the buoyant casing, it decreases the positive buoyancy of casing, causing the buoyant casing to sink in the surrounding fluid. When the fluid sufficiently decreases the buoyancy of the outer casing, the casing slides downward closing the chamber air exhaust valve permitting air escape and opening the compressed air inlet valve permitting compressed air entry. Compressed air of sufficient pressure to overcome the head against which the pump must move fluid is applied to the casing through the second and open pneumatic valve. This pressure within the enclosed pump chamber pushes the fluid up, out of the pump through the fluid discharge conduit and check valve, preventing re-entry of discharged fluid into the pump. When the fluid level in the pump has been lowered sufficiently, the casing will become buoyant again and rise along the discharge pipe. The cycle will repeat. In this manner, the pump cycles until the fluid fails to fill the pump sufficiently to trigger the pneumatic valve or the pressure of the compressed air drops below the total developed head of the pump.

DESCRIPTION OF THE PREFERRED EMBODIMENTS

Figure 1:
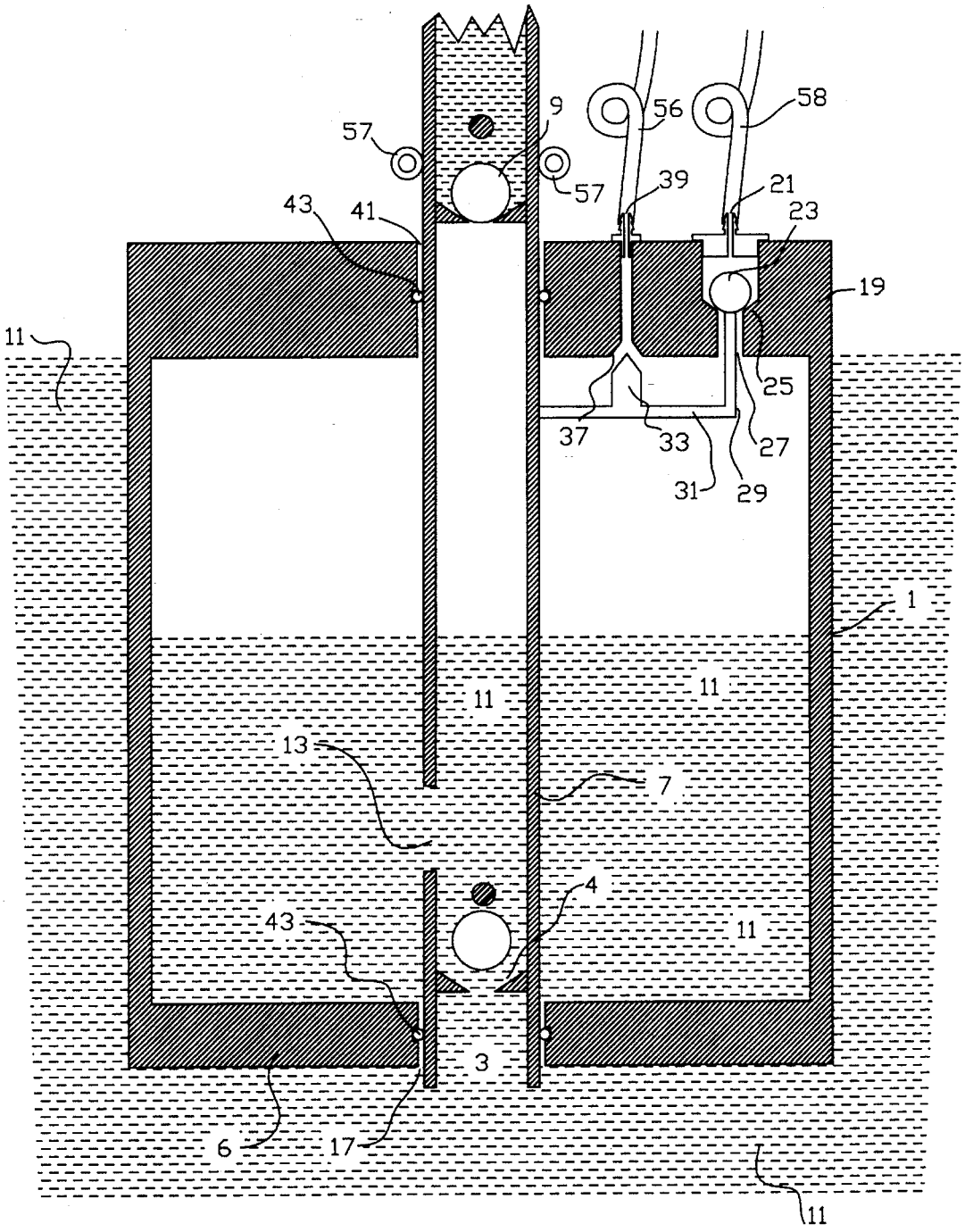
FIG. 1 is a sectioned view of a pump in accordance with the invention showing air and fluid conduits, an outer casing and discharge piping assembly, a pneumatic valve assembly and check valves.

Referring to FIG. 1, the outer extremities of pump P consist of buoyant outer casing 1, closed at the bottom by lower head 6 and closed at the top by upper head 19. Check valve 4 mounted in discharge pipe 7 allows fluid to enter the buoyant outer casing 1 and prevents back flow. Check valve 9 mounted in discharge pipe 7 allows fluid to pass out of the pump and not return. As will hereafter be made clear, air into and out of buoyant outer casing 1 causes pumping to occur.

A bore 41 is provided in upper head 19. Discharge pipe 7 passes through bore 41. Likewise, there is bore 17 in lower head 6 through which discharge pipe 7 passes. Slidable seals 43 in upper head 19 and lower head 6 allow discharge pipe 7 to slide in relationship to the outer casing 1 without allowing passage of fluid or air into or out of the outer casing 1.

The entire pump is supported in the fluid being pumped by support loops 57 on discharge pipe 7. Discharge pipe 7 has enough weight to keep the entire pump submerged even when buoyant outer casing 1 is empty of fluid. Discharge pipe 7 has opening 13 at its lower end to allow fluid 11 to enter and exit buoyant outer casing 1.

Compressed air inlet valve poppet 23 and air exhaust poppet 33 are attached to the discharge pipe 7 via support arm 31. These valve poppets 23 and 33 are shown supported on one arm. Such valves could be supported on a plurality of arms on opposite sides of the discharge pipe 7. Above air exhaust poppet 33 is exhaust sealing face 37 in upper head 19. Above exhaust sealing face 37 is exhaust conduit 39 in upper head 19. Compressed air inlet valve poppet 23 is connected to support arm 31 via stem 29. Stem 29 passes up through bore 27 in upper head 19. Stem 29 supports compressed air inlet valve poppet 23 above sealing face 25 in compressed air inlet conduit 21. Above exhaust conduit 39 is flexible conduit 56 which connects exhaust conduit 39 to atmosphere, to the gas above fluid 11 being pumped, or into fluid 11 above the pump. The gas in the pump will be able to exhaust as long as the pressure at the outlet of the exhaust conduit 39 is less than that inside the casing 1.

Above compressed air inlet conduit 21 is flexible conduit 58 which connects compressed air inlet conduit 21 to a source of compressed air (not shown). Flexible conduits 56, 58 are of such construction and arrangement that they apply little or no force to buoyant outer casing 1 and thus do not interfere with the travel of buoyant outer casing 1. This can be achieved using commercially available flexible air tubing or hose (e.g. Norgren tubing, Parker 801 hose or Goodyear Instagrip hose) for the conduits 56, 58 with one or more loops in the hoses to allow buoyant outer casing 1 to travel without being adversely affected by the hoses. The hoses can then be attached to discharge piping 7 above the pump using cable ties (not shown) to maintain the relative position of the loops in the hoses.

When buoyant outer casing 1 is nearly empty of fluid, it is buoyant in the fluid 11. Thus, when the pump is nearly empty, buoyant outer casing 1 along with lower head 6 and upper head 19 slides vertically upwards relative to discharge pipe 7, exhaust poppet 33 moves away from sealing face 37 in exhaust conduit 39, while at the same time compressed air inlet valve poppet 23 moves onto sealing face 25 in the compressed air inlet conduit 21. This allows air inside buoyant outer casing 1 to escape through exhaust conduit 39 and prevents air from entering into buoyant outer casing 1 through compressed air inlet conduit 21. This is known as the exhaust phase of the pump cycle. During this phase, fluid 11 enters the outer casing 1 through inlet check valve 4.

When buoyant outer casing 1 becomes full of fluid, it becomes heavier than the surrounding fluid 11 and it sinks in the surrounding fluid 11 and thus slides downwards relative to the discharge pipe 7. Sealing face 37 is moved towards and against exhaust poppet valve 33, while at the same time sealing face 25 is moved away from compressed air inlet valve poppet 23. This causes compressed air to enter buoyant outer casing 1 through compressed air inlet conduit 21 and prevent air from exhausting from buoyant outer casing 1 through exhaust conduit 39. This is the pressurization phase of the pump cycle.

The compressed air which enters buoyant outer casing 1 forces fluid out of the pump through discharge pipe 7 and outlet check valve 9. The cycle is repeated until fluid 11 does not fill buoyant outer casing 1 sufficiently to cause buoyant outer casing 1 to sink or the compressed air pressure is insufficient to push the fluid out of buoyant outer casing 1.

Figure 2A:
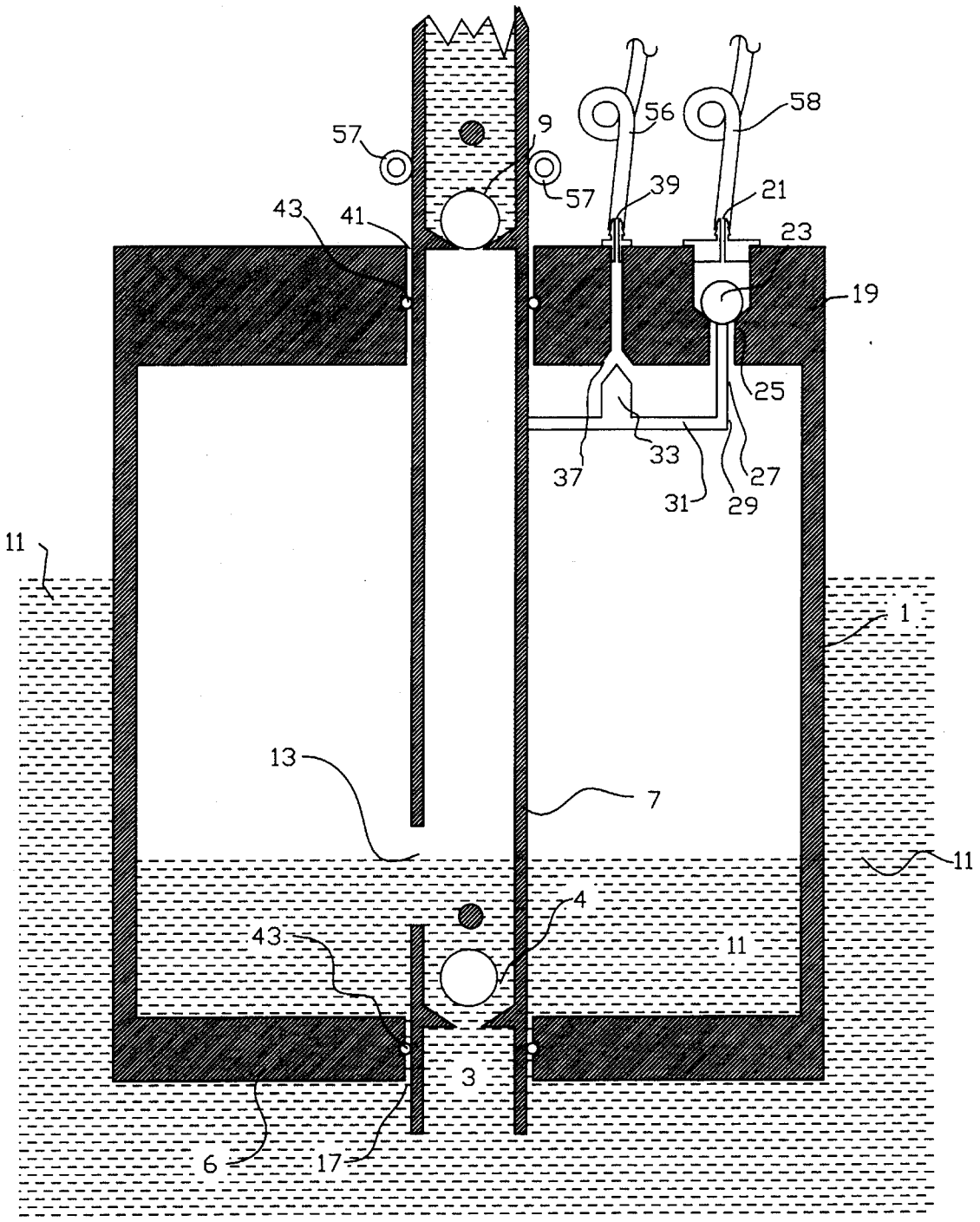
FIGS. 2A and 2B show a buoyant pump casing actuating the casing exhaust valve and compressed air inlet valve as the pump respective fills in FIG. 2A and empties in FIG. 2B with fluid.

FIG. 2A shows the pump when buoyant outer casing 1 is beginning to fill with fluid. When the pump is empty and submerged in fluid 11, buoyant outer casing 1 is buoyant in the surrounding fluid 11 and is thus in the raised or exhaust position. This position has air exhaust poppet 33 away from exhaust sealing face 37 in exhaust conduit 39. Compressed air inlet valve poppet 23 is sealed against sealing face 25 in compressed air inlet conduit 21. This allows air to exhaust from buoyant outer casing 1 and allows fluid 11 enters the pump through inlet check valve 4 and passes into buoyant outer casing 1 through opening 13 in the discharge pipe 7.

Figure 2B:
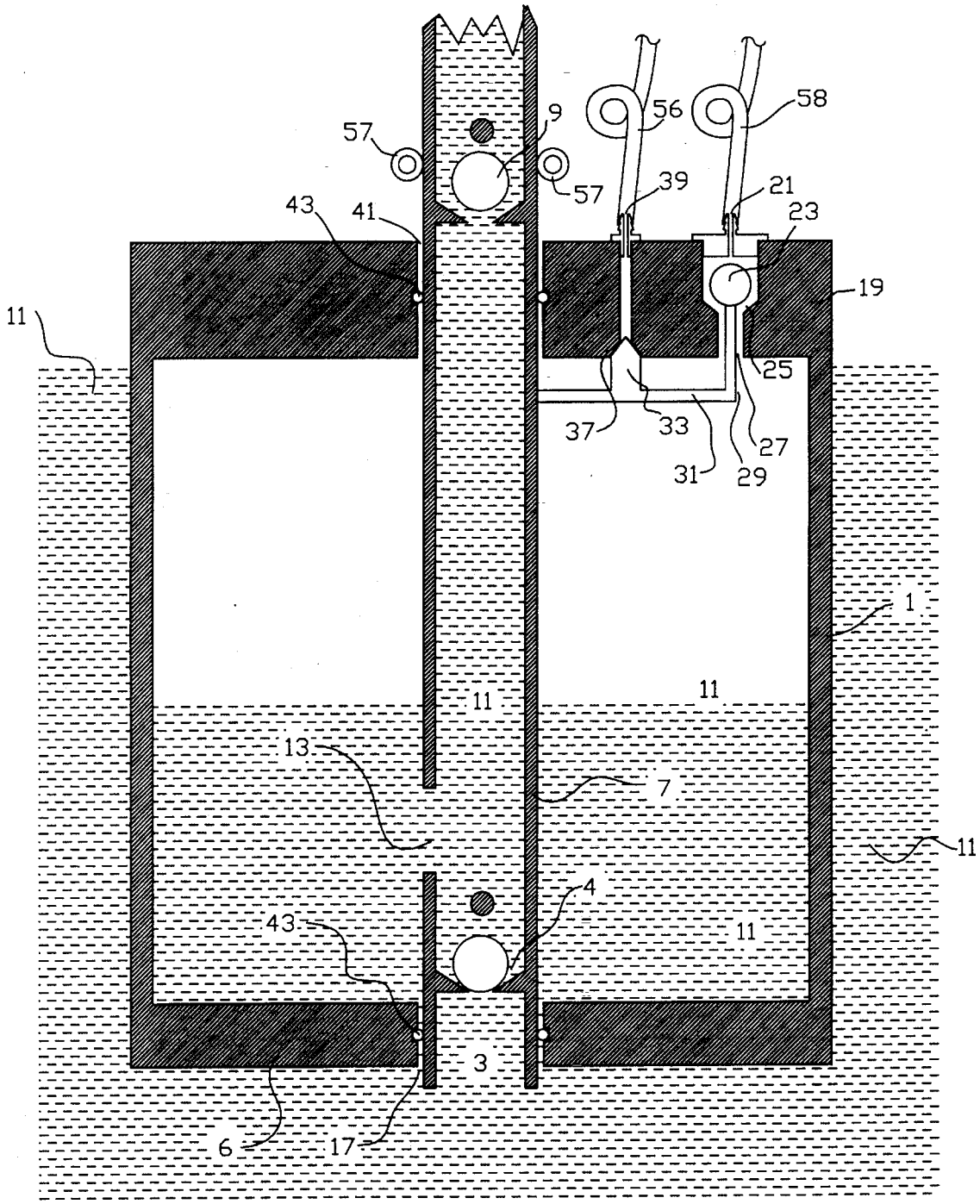

FIG. 2B shows the pump when the pressurization phase has begun. As fluid 11 enters, buoyant outer casing 1 becomes less buoyant. Eventually buoyant outer casing 1 will sink in fluid 11 and slide downward relative to discharge pipe 7. When this occurs, air exhaust poppet 33 will be against its sealing face 37 and compressed air inlet valve poppet 23 will be away from its sealing face 25. In this position air is prevented from exhausting from the outer casing 1 and compressed air is allowed into buoyant outer casing 1. The compressed air pushes the fluid in buoyant outer casing 1 out through opening 13 in discharge pipe 7 and out through check valve 9. Fluid 11 is pushed out of check valve 9 until buoyant outer casing 1 becomes buoyant and shifts upwards, opening exhaust conduit 39 and closing off the compressed air inlet conduit 21. Fluid 11 can then enter the pump through inlet check valve 4 while check valve 9 prevents fluid 12 from coming back into the pump.

Figure 3A:
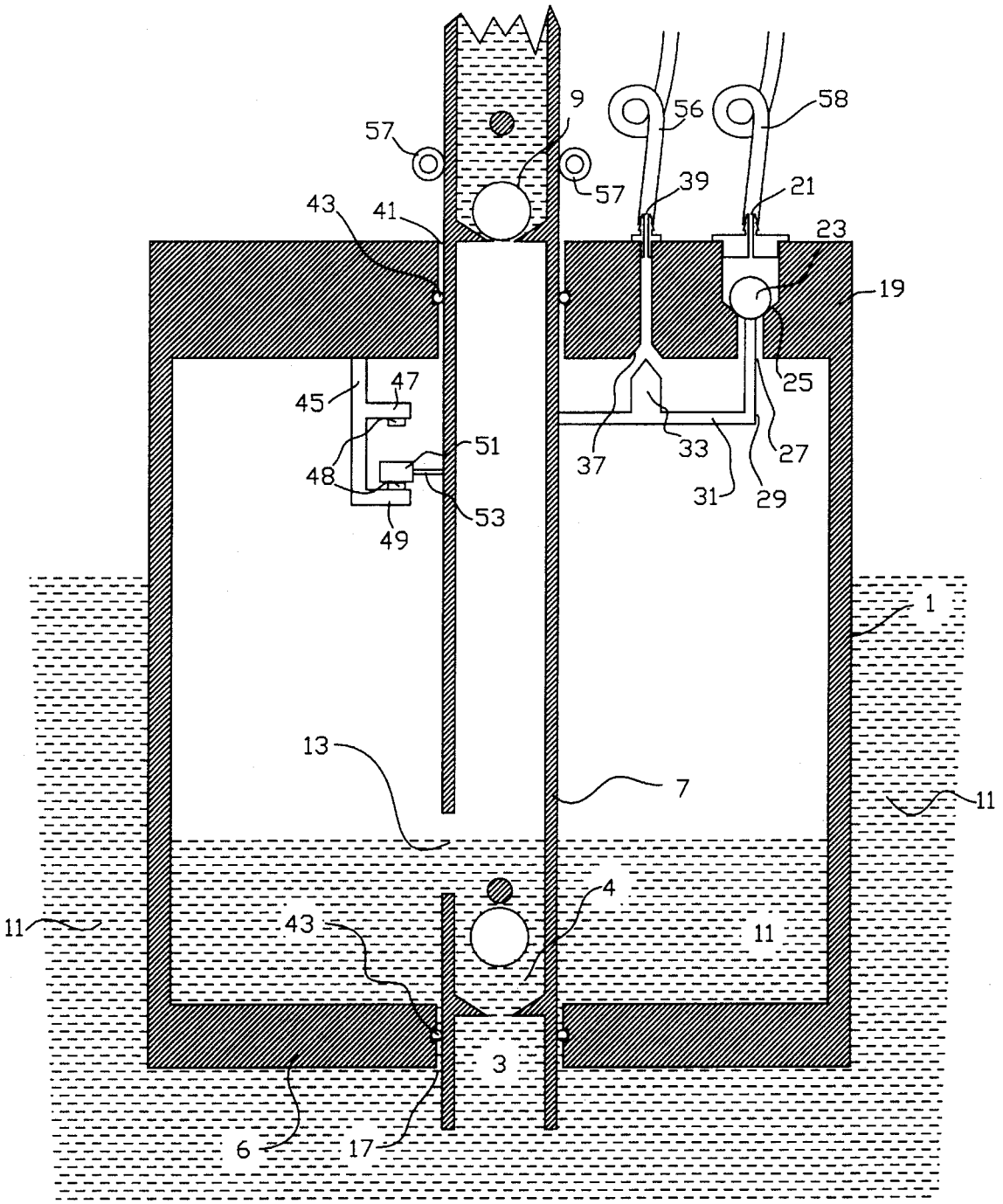
FIGS. 3A and 3B show a magnetic detent device inside the pump in its two latching positions as the pump respectively fills and empties.
Figure 3B:
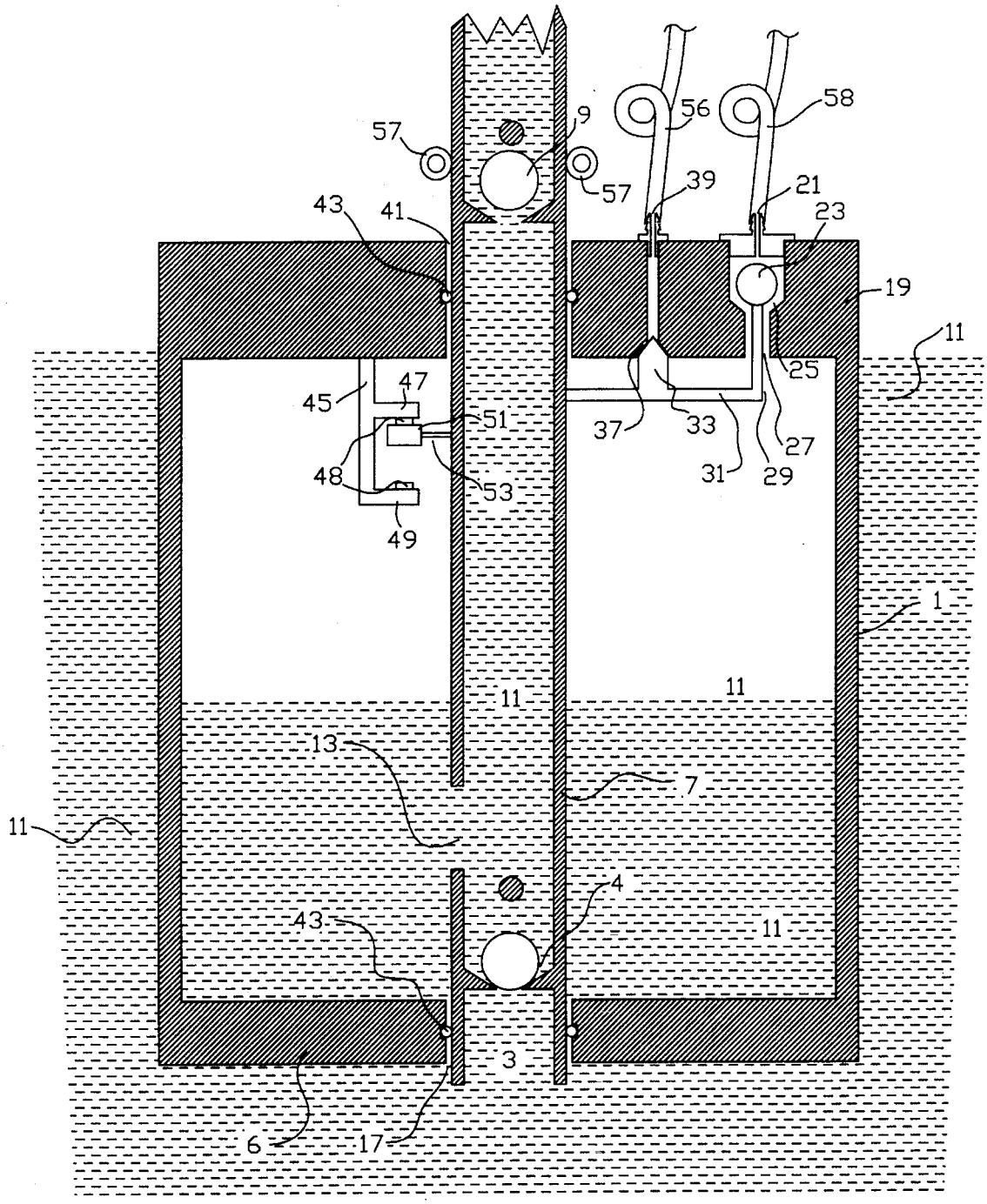

FIG. 3A and 3B show the pump with a magnetic detent system. This embodiment shows the use of a detent device that can retard the shifting of outer buoyant casing 1 until greater shifting force is built up. This enhances the shifting of outer buoyant casing 1. The purpose of this detent system is to ensure the complete and rapid travel of buoyant outer casing 1 between its two positions relative to discharge pipe 7.

Connected to discharge pipe 7 via support arm 53 is magnet 51. Attached to the upper head 19 via support arm 45 is upper magnetic plate 47 and lower magnetic plate 49. These plates 47 and 49 can be made from carbon steel, magnetic stainless steel or any magnetic material to which the magnet 51 would be attracted, including other magnets. When magnet 51 is resting on the upper magnetic plate 47, the pump has filled with fluid and the outer casing 1 has shifted downwards. Air exhaust poppet 33 is sealed against its sealing face 37 and compressed air inlet poppet 23 is away from its sealing face 25. The pump is then in the pressurization phase of the pump cycle and fluid 11 is pushed out of the pump. When the magnet 51 is resting on lower magnetic plate 49, exhaust poppet 33 is away from its sealing face 37 and compressed air inlet poppet 23 is seated against its sealing face 25. The pump is then in the exhaust phase of the pump cycle and fluid 11 enters the pump.

When buoyant outer casing 1 is in its lower position relative to discharge pipe 7, magnet 51 rests on the upper magnetic plate 47. Compressed air enters buoyant outer casing 1 through compressed air inlet conduit 21 and pushes fluid 11 out of the pump. Magnet 51 holds onto upper magnetic plate 47 and thus holds buoyant outer casing 1 stationary relative to discharge pipe 7 until sufficient force is developed in the buoyancy of buoyant outer casing 1 to cause magnet 51 to separate from upper magnetic plate 47. Buoyant outer casing 1 then travels quickly and unhesitatingly upwards relative to discharge pipe 7 until magnet 51 rests on lower magnetic plate 49. This causes the pump to shift from the pressurization phase of the pump cycle to the exhaust phase of the pump cycle quickly and unhesitatingly. During the exhaust phase of the pump cycle, fluid 11 enters the outer casing through inlet check valve 4. When buoyant outer casing 1 becomes sufficiently full of fluid 11 to sink in surrounding fluid 11 and have sufficient weight to cause magnet 51 to separate from lower magnetic plate 49, buoyant outer casing 1 travels quickly and unhesitatingly downwards relative to discharge pipe 7, magnet 51 and poppets 33, 23 until magnet 51 again rests on upper magnetic plate 47. This causes the pump to shift from the exhaust phase of the pump cycle to the pressurization phase of the pump cycle quickly and unhesitatingly.

Upper magnetic plate 47 and/or lower magnetic plate 49 can be positioned such that magnet 51 does not contact them, but comes to rest at each extreme of the travel of buoyant outer casing 1 in proximity to the plates 47 and 49.

This can be accomplished by allowing the poppet valves 33, 23 to come to rest on their respective sealing faces 37, 25 before the magnetic plates touch magnet 51. This can also be accomplished by the mechanical stops shown in FIG. 6. This can prolong the life of magnet 51.

Bumper 48 can be placed on either or both magnetic plates 47 and 49 to absorb the shock of magnet 51 coming to rest on magnetic plates 47 and 49. This also can prolong the life of magnet 51. The strength and/or size of magnet 51 and the distance between magnetic plates 47 and 49 can be changed to cause buoyant outer casing 1 to sustain a greater or lesser degree of change of the level of fluid 11 inside buoyant outer casing 1 before the outer casing shifts, causing the pump to enter into the next phase of the pump cycle.

There are other arrangements of magnets and attractive surfaces that are possible. These include upper and lower plates 47 and 49 having magnets imbedded in them and a ferrous plate would then be substituted for magnet 51. Either or both upper and lower plates 47 and 49 can have magnets in them and magnet 51 can thus be even more strongly held in position.

The reader will understand that the disclosed magnets constitute generically a detent mechanism. Other types of detents can be used. They are not specifically illustrated here because the magnets disclosed are preferred.

Figure 4:
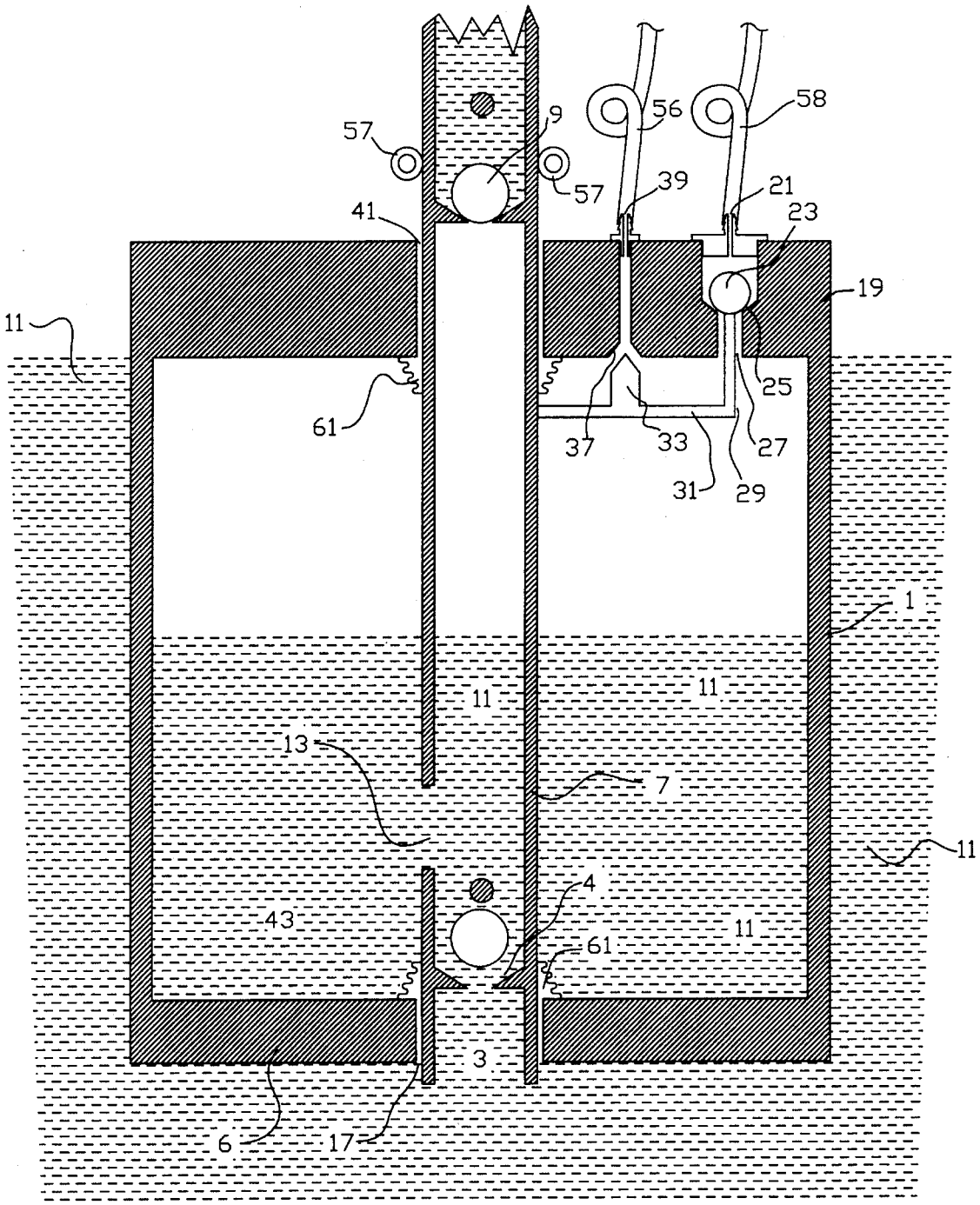
FIG. 4 shows flexible bellows on the top and bottom of the discharge tubing of the pump.

Referring to FIG. 4, the pump is shown with flexible bellows 61 at each end of discharge pipe 7. Bellows 61 serve as a seal to prevent fluids and gases from entering and exiting buoyant outer casing 1. Bellows 61 expand at the top of discharge pipe 7 and compress at the bottom of the discharge pipe 7 when buoyant outer casing 1 shifts upwards. Bellows 61 compress at the top of discharge pipe 7 and expand at the bottom of discharge pipe 7 when buoyant outer casing 1 shifts downwards. Such bellows 61 can be constructed from metal, such as stainless steel, an elastomer, such as Hytrel from DuPont, or from any other flexible material that can withstand the chemicals, temperatures and pressure that the pump is subjected to.

Bellows 61 can also be mounted outside buoyant outer casing 1. Bellows 61 can be mounted both inside and outside the outer casing 1. A flexible diaphragm connecting discharge pipe 7 and upper head 19 and another diaphragm connecting discharge pipe 7 and lower head 6 can be used instead of bellows.

Figure 5A:
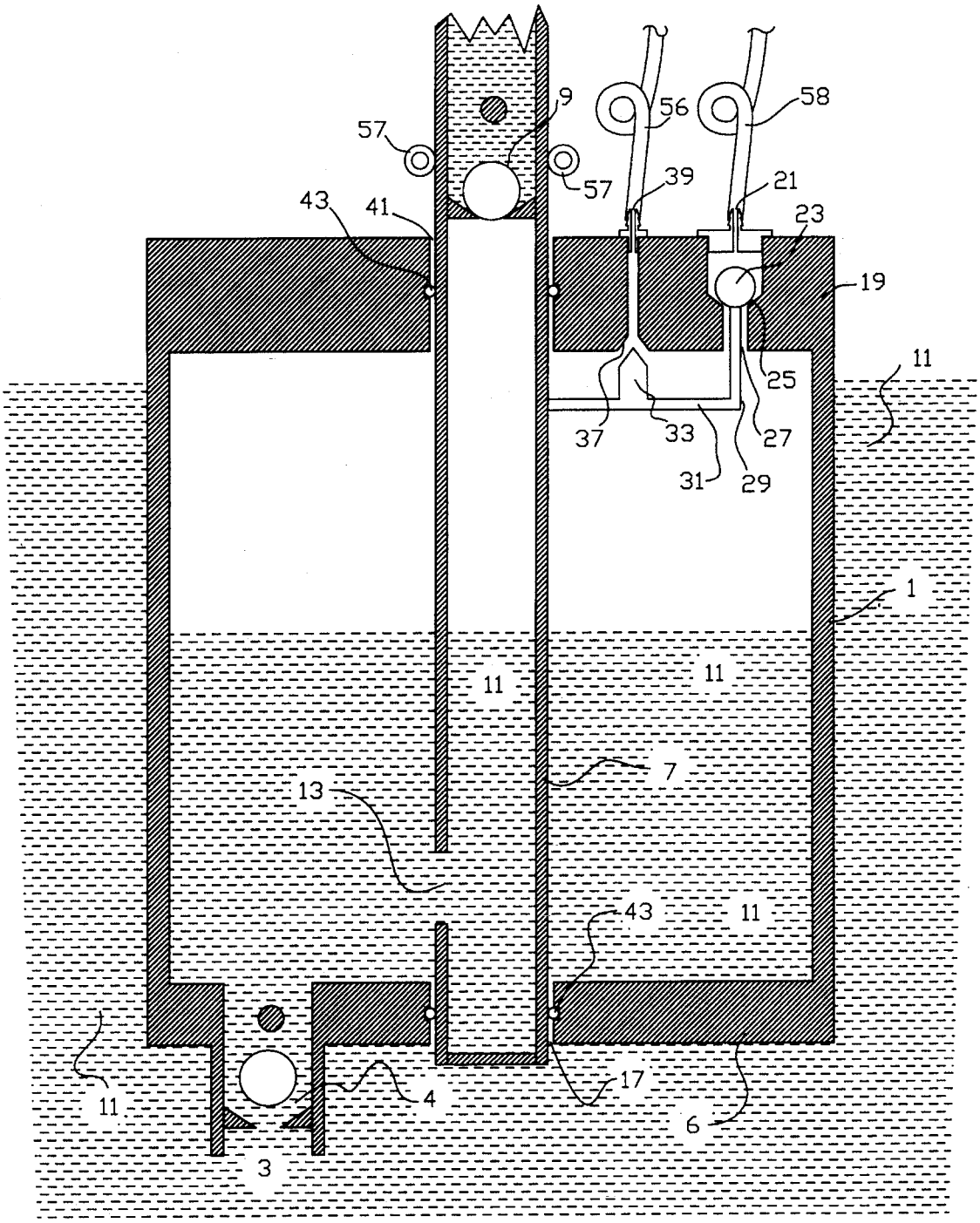
FIGS. 5A, 5B, 5C show other possible fluid inlet configurations of the pump.

Referring to FIG. 5A, inlet check valve 4 is mounted in lower head 6 instead of attached to discharge pipe 7. Discharge pipe 7 is closed at its lower extremity.

Figure 5B:
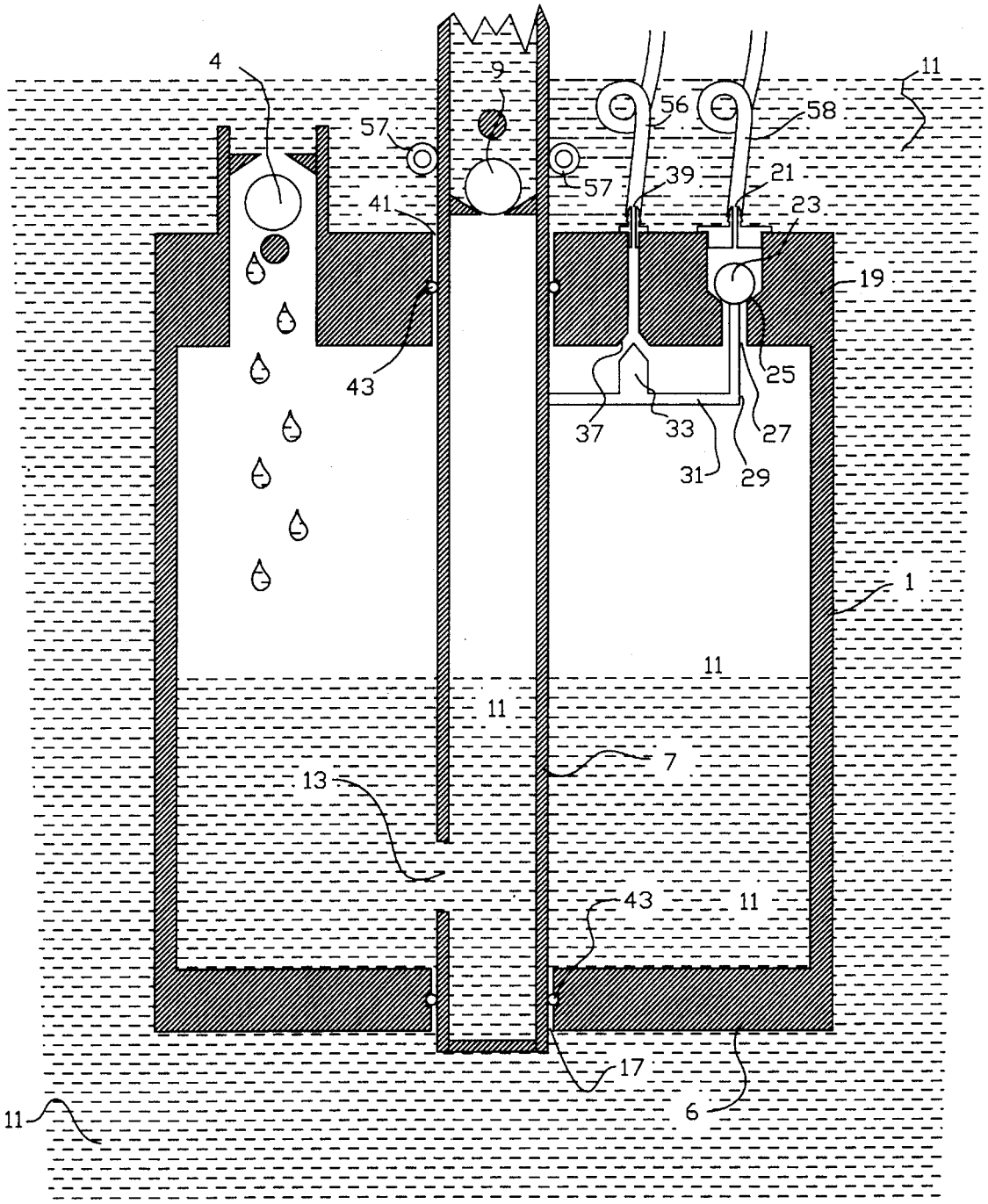

At FIG. 5B, inlet check valve 4 is shown mounted in upper head 19 of the pump. The flow and pressure of the compressed air entering the pump would close this valve during the pressurization cycle.

Figure 5C:
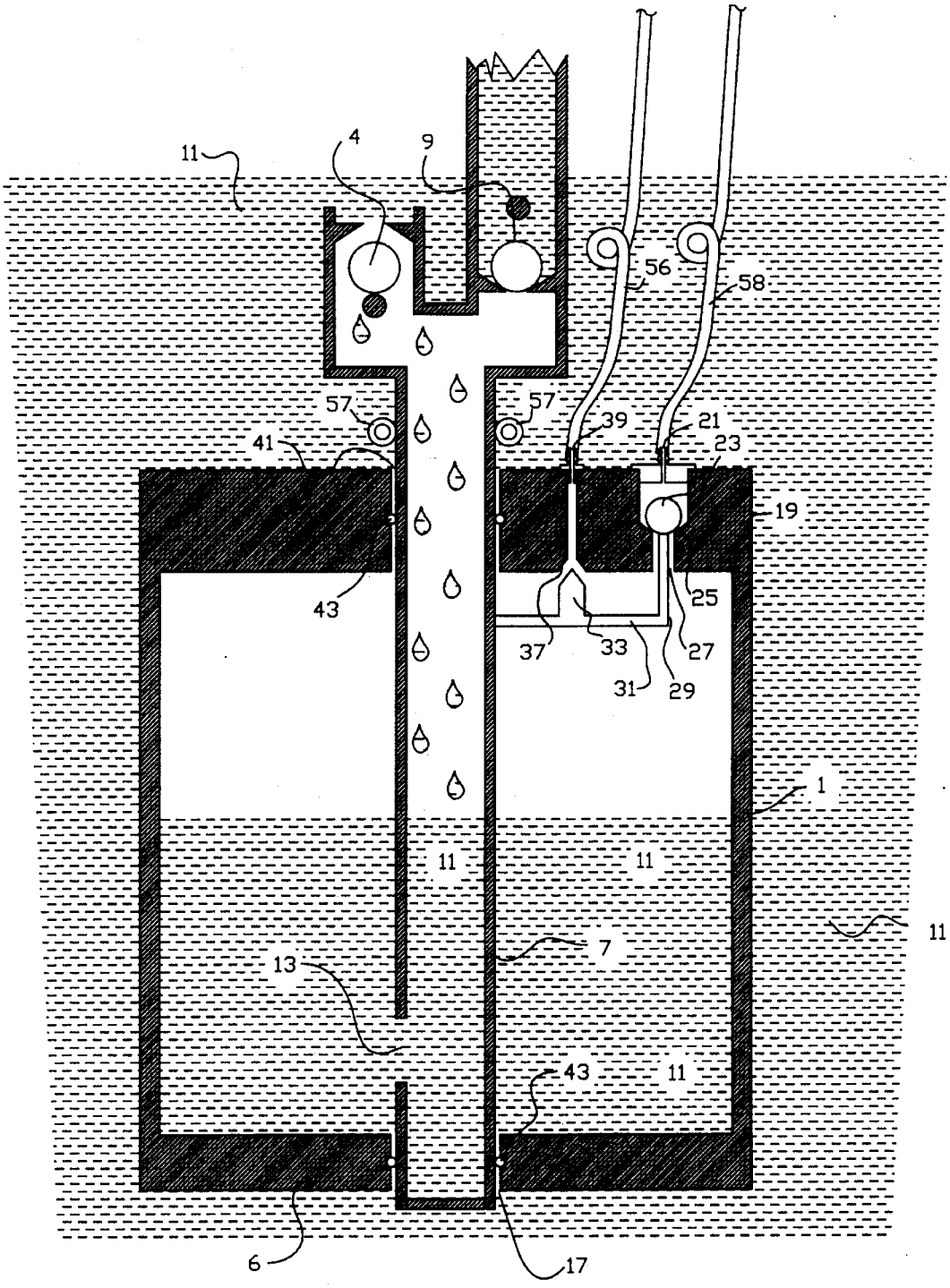

FIG. 5C shows inlet check valve 4 along with discharge check valve 9 mounted in a "Y" fitting 71 on upper end of discharge pipe 7. Both check valves 4 and 9 are opened and closed by the force of fluid upon them during the pressurization and exhaust cycles.

Figure 6:
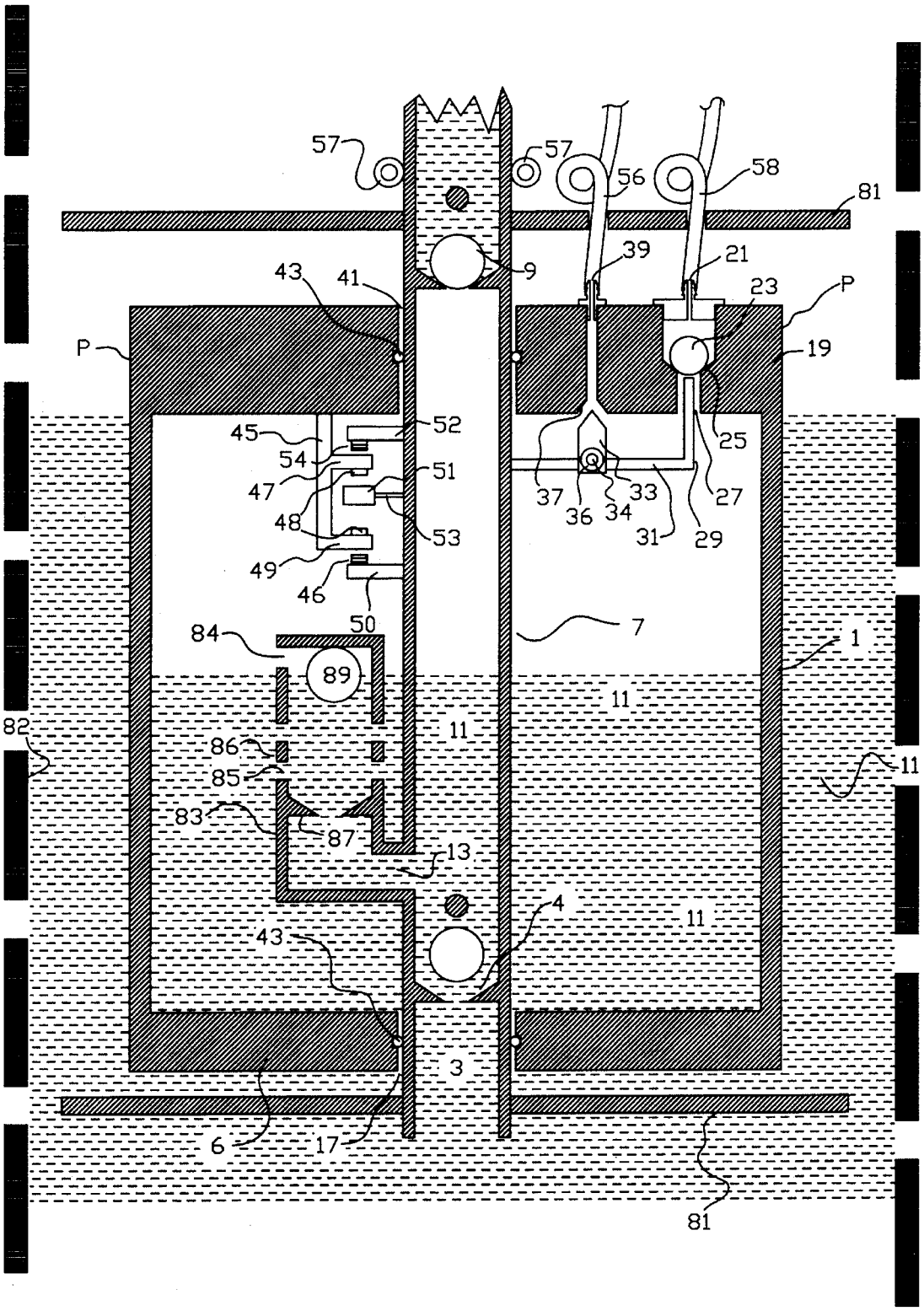
FIG. 6 shows a spacer above and below the pump casing to prevent it from hanging up on a well casing, with slack devices in the valves and mechanical stops for the casing.

FIG. 6 shows two centering devices 81 above and below the pump and attached to the discharge pipe 1. These can be in the shape of a disk with an outside diameter larger than that of the outer casing 1 and smaller than the inside diameter of perforated well casing 82, in which the system is suspended. These centering devices 81 remain motionless relative to the outer casing 1 and keep the outer casing 1 from hitting the sides of the pump or well in which the pump is positioned when the outer casing 1 shifts upwards or downwards.

An arm 52 can be rigidly attached to the discharge pipe 7 to hold a mechanical stop 54 above the upper magnetic plate 47. This would limit the travel of the outer casing 1 so the magnet 51 would not come in contact with the upper magnetic plate 47. This can prolong the life of the magnet 51. Likewise an arm 50 can be rigidly attached to the discharge pipe 7 to hold a mechanical stop 46 below the lower magnetic plate 49. This would limit the travel of the outer casing 1 so the magnet 51 would not come in contact with the lower magnetic plate 49. This can prolong the life of the magnet 51.

Slack devices in the valving system can be advantageous in that the outer casing 1 can be already moving before the valves are moved. This would give the outer casing 1 a running start to ensure the valves shifted. Slack devices can be built into the valving of the system by creating an enlarged or elongated bore 36 in the exhaust poppet 33 and mounting the exhaust poppet 33 on a pin 34 on the support arm 31. A similar thing can be done with the inlet poppet 23. In addition, the inlet poppet 23 can be made in the shape of a ball and separated from its stem 27. This would also create a slack device.

To prevent compressed air from rushing out of discharge pipe 7, when pump P is suspended by holding rings 57 above fluid 11, air exclusion valve 83 can be installed In discharge pipe opening 13. Air exclusion valve 83 consists of an outer perforated casing 86 with fluid inlet openings 85 located above ball seat 87, a buoyant ball 89 and a relief opening 84 near the upper end of perforated casing 86. When fluid 11 is inside outer casing 1, buoyant ball 89 floats away from seat 87 and fluid 11 can easily pass into and out of discharge pipe 7 and air exclusion valve 83 through perforations 85. When fluid 11 becomes low in outer casing 1, buoyant ball 89 floats down and rests on seat 87 to prevent compressed air or fluid 11 from passing into discharge pipe 7. When compressed air entering outer casing 1 is shut off by submerging outer casing 1 in fluid 11 and thus causing outer casing 1 to rise relative to discharge pipe 7 and thus close compressed air inlet conduit 21, fluid 11 again enters through inlet check valve 4. When fluid 11 enters buoyant ball will rise from seat 87 to allow fluid 11 to enter outer casing 1 and begin the pump cycle.

Figure 7:
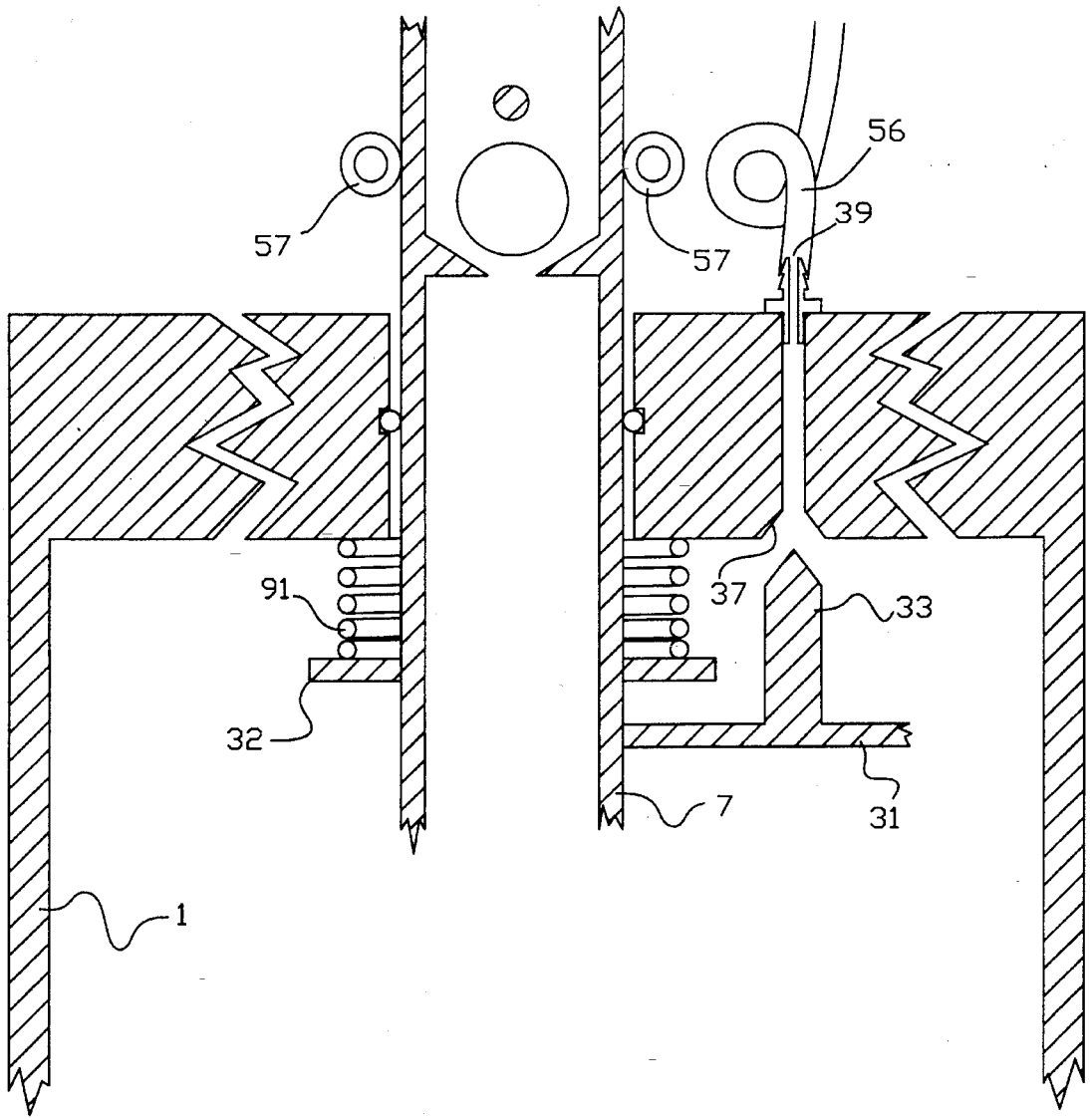
FIG. 7 shows a spring mechanism for balancing the weight of the outer casing of the pump.

FIG. 7 shows spring 91 mounted on disk 32 which is attached to discharge pipe 7 below upper head 19. Spring 91 exerts an upwards force on upper head 19 equal to the sum of the weights of buoyant outer casing 1, upper head 19 and lower head 6 and any attachments thereto. Spring 91 may be needed when buoyant outer casing 1, heads 6, 19 and any attachments overcome the buoyancy of the outer casing in the surrounding fluid 11. Thus the change in buoyancy of buoyant outer casing 1 as it fills and empties will cause the outer casing to shift relative to the discharge pipe 7 regardless of the weight of the outer casing, pump heads 6, 19 and any attachments to those items.

Figure 8A:
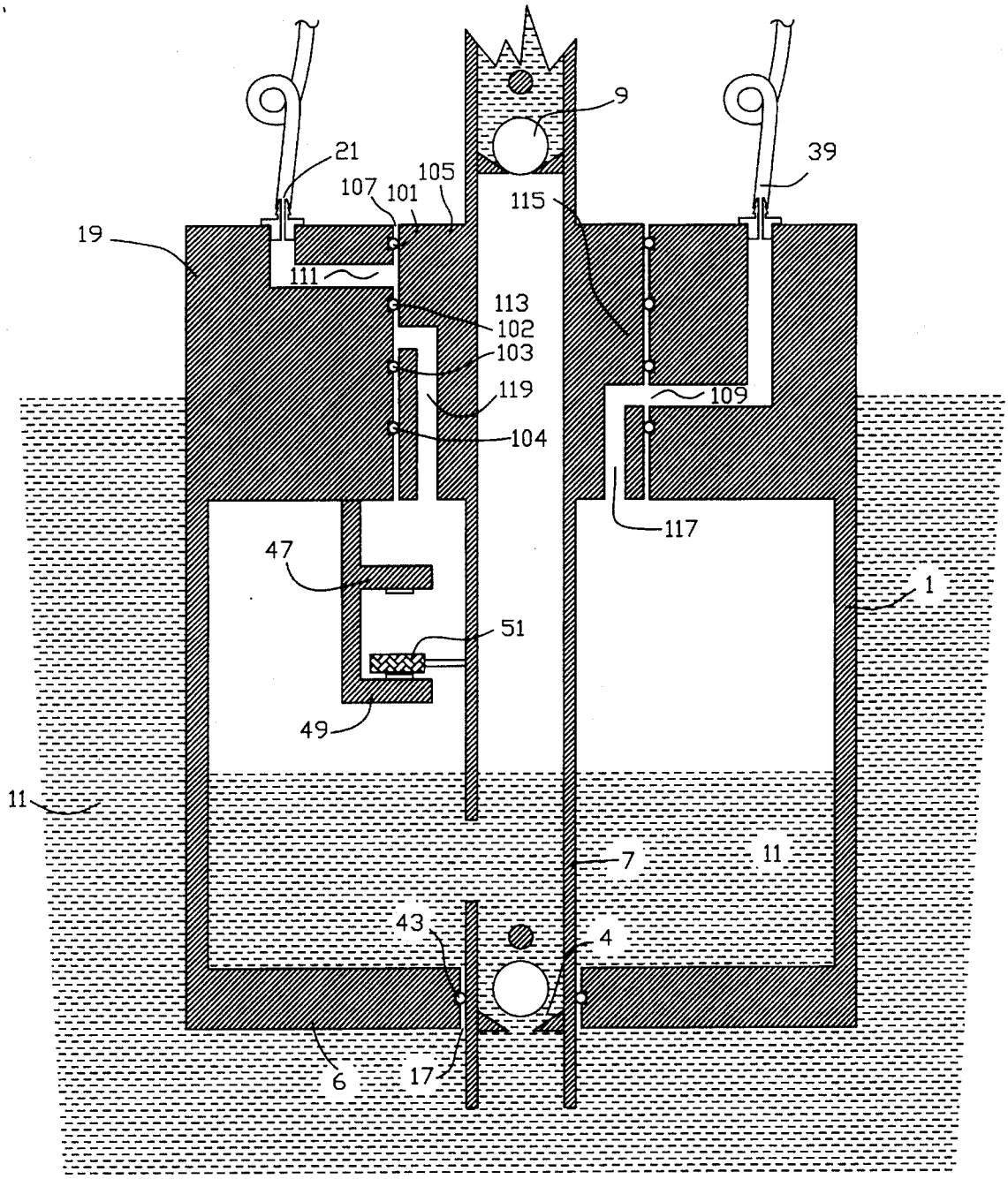
FIG. 8A and 8B show a spool-type valve design actuated to respectively fill and empty the buoyant pump casing.

FIG. 8A shows the pump with buoyant outer casing 1 in the raised (exhaust) position. Spool valve 105 is rigidly attached to discharge pipe 7. Spool valve 105 slides longitudinally in bore 107 in upper head 19 of the pump. When buoyant outer casing 1 and both heads 6, 19 are in the raised and relatively buoyant with respect to fluid 11, opening 109 of air exhaust conduit 21 in upper head 39 is aligned with opening 115 of air exhaust bore 117 in spool valve 105, while the opening of compressed air inlet conduit 111 is above and sealed off from opening 113 of compressed air inlet conduit 119 of spool valve 105. Low friction sliding seals 101, 102 (such as those available from Bal Seal Engineering Company of Santa Ana, Calif.) serve to block the compressed air from flowing from the compressed air conduit 21 into the pump. Seals 103 and 104 seal the exhaust air from leaving exhaust air conduit 21. In this position, the pump fills with fluid 11 until it becomes heavy and sinks.

Figure 8B:
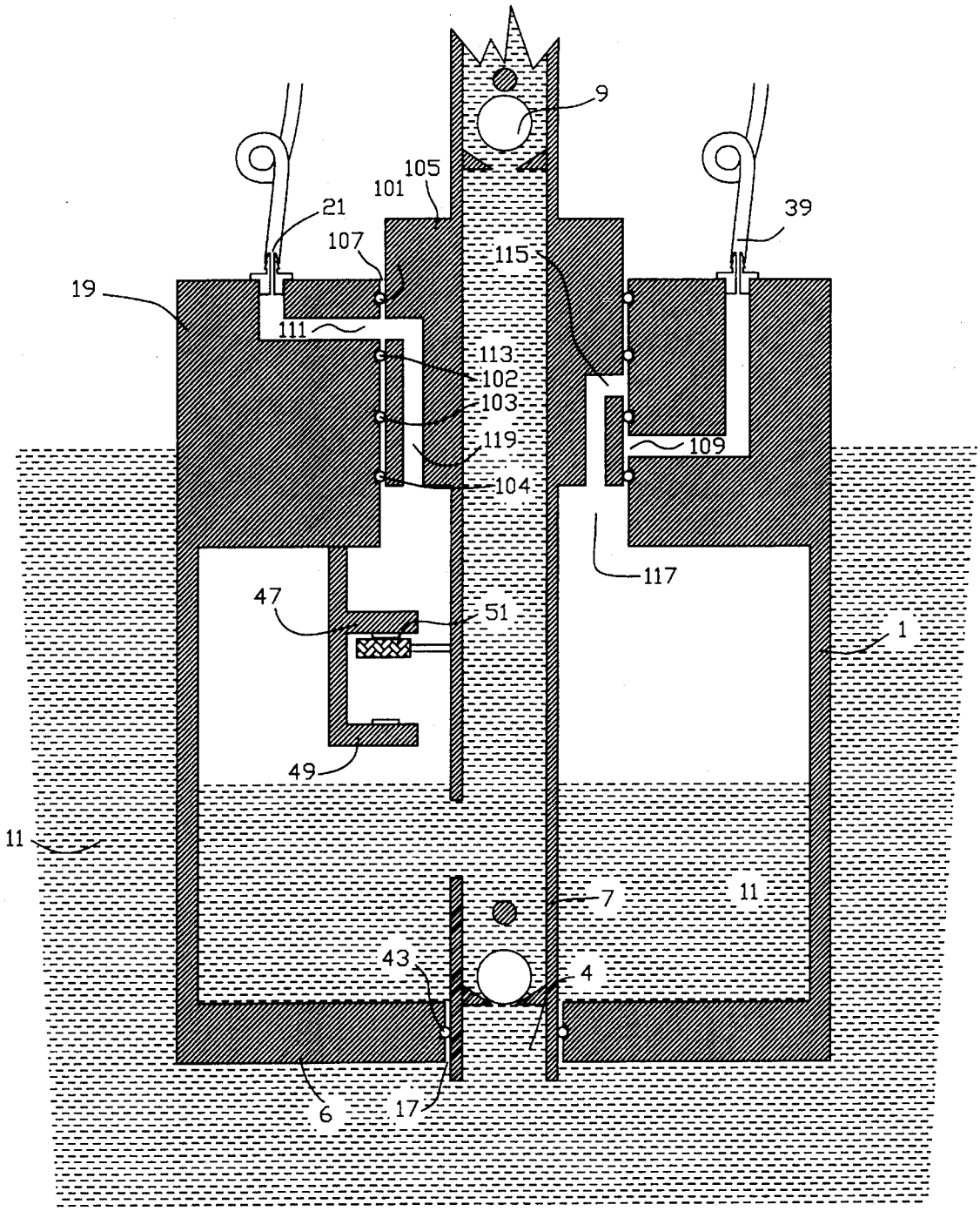

FIG. 8B shows the pump with buoyant outer casing 1 in the lower (pressurization) position.

When buoyant outer casing 1 fills with fluid 11 and shifts downwards to the pressurization position, opening 109 of exhaust conduit 21 in upper head 19 is sealed between seals 103, 104 and is aligned with the solid part of spool valve 105 below opening 115 in exhaust conduit 117. Opening 115 is sealed between seals 102 and 103 and thus compressed air cannot exit buoyant outer casing 1, while opening 111 of the compressed air inlet conduit 39 is aligned with opening 113 of compressed air conduit 119 in spool valve 105. Seals 101 and 102 keep the compressed air from passing out bore 107 and thus compressed air enters buoyant outer casing 1 and pushes fluid 11 out of discharge pipe 7 and discharge check valve 9. When buoyant outer casing 1 is thus emptied, casing 1 becomes buoyant and shifts upwards relative to discharge pipe 7 and spool valve 105 to the exhaust position so the pump can fill again. The diameter of discharge pipe 7 where it passes through lower head 6 will be constructed to ensure the pressure inside buoyant casing 1 does not cause discharge pipe 7 to move due to a piston effect.

Figure 9:
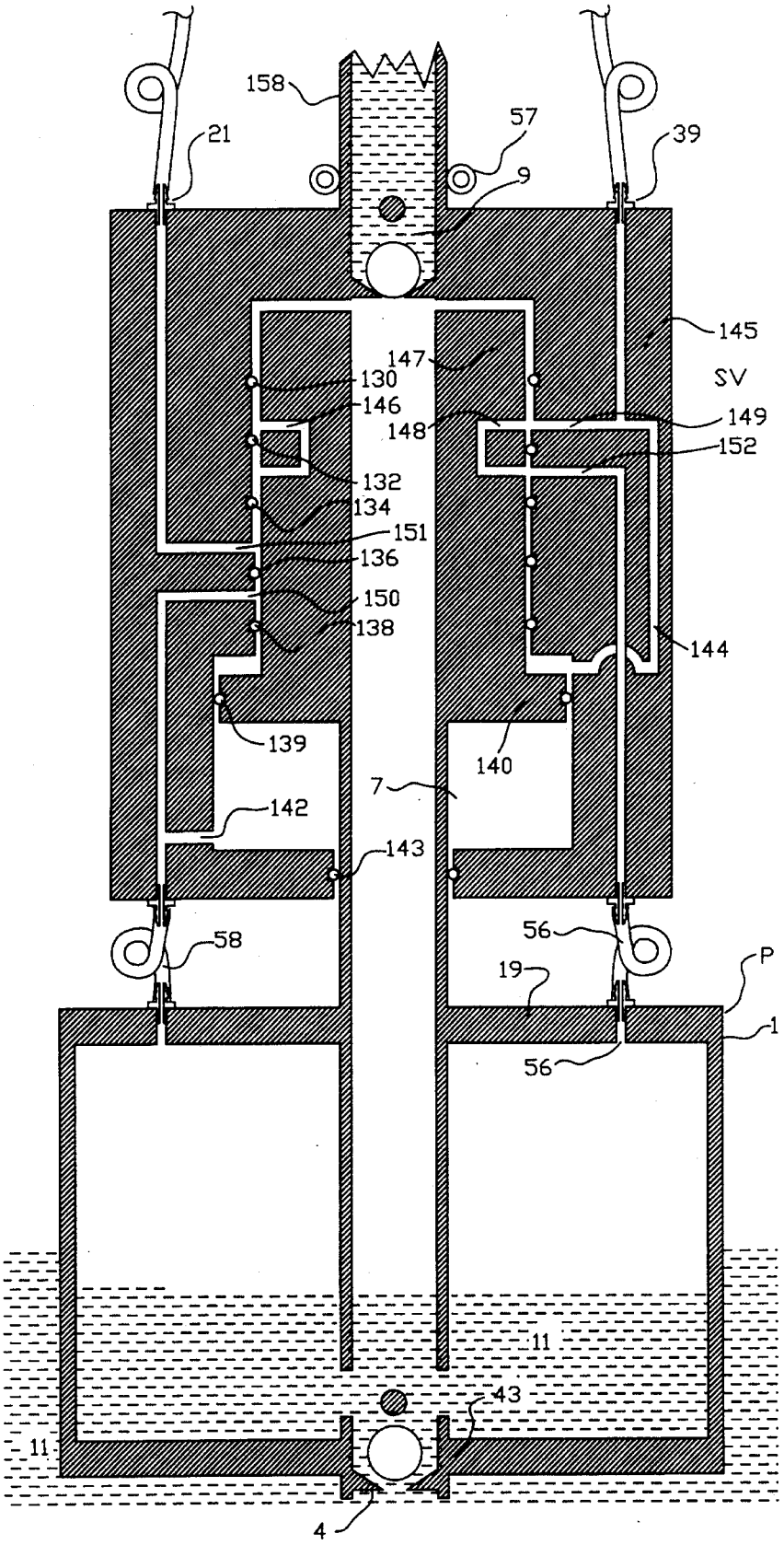
FIG. 9 is a view in cross-section of an embodiment where the control valving is moved away from the enclosed buoyant casing and resides in attachment to the discharge pipe.

FIG. 9 shows an air spool valve SV positioned above pump casing 1. The advantage to this embodiment is that by mounting the air valving outside the casing 1, manufacturing expense can be decreased. The inner core 147 of the spool valve SV is rigidly attached to discharge pipe 7, while the outer sleeve 145 of spool valve SV is rigidly attached to discharge piping 158 extending above the assembly. Flexible conduits 58, 56 connect spool valve outer sleeve 145 to upper head 19 of pump P. Compressed air passes through compressed air inlet 58 into pump P to push fluid 11 up discharge pipe 7. Exhaust gas from pump P pass out opening 58 in upper head 19, through flexible tube 56 and into spool valve outer sleeve 145. Compressed air enters spool valve outer sleeve 145 via opening 21. Exhaust gas exits spool valve outer sleeve 145 via opening 39.

When outer casing 1 of pump P is empty and therefore buoyant, spool valve inner sleeve 147 is raised relative to spool valve outer sleeve 145. In the raised position, passage 146 in spool valve inner sleeve 147 is aligned with conduits 149 and 152, while passage 146 is sealed away from conduits 151 and 150, preventing compressed air to enter outer casing 1. This alignment allows exhaust gas to exit outer casing 1 and allow fluid 11 to enter outer casing 1 through lower check valve 4. When outer casing 1 is full of fluid 11, it becomes negatively buoyant and sinks in fluid 11. This causes spool valve inner sleeve 147 to shift downwards relative to spool valve outer sleeve 145 and close off passage 148 to atmosphere and thus prevent gas from escaping from outer casing 1 and align passage 146 with conduits 151 and 150. This allows compressed air to pass into outer casing 1 to push out fluid 11 through outlet check valve 9.

Sliding seals 130, 132, 134, 136, 138 prevent the passage of gas as spool valve inner sleeve 147 slides relative to spool valve outer sleeve 145. Sliding seal 143 prevents fluid 11 from entering into the internals of spool valve SV.

Due to forces exerted on spool valve inner sleeve 147 and spool valve outer sleeve 145 when fluid 11 is being pushed out of outer casing 1, some valve balancing mechanisms may be necessary. Shown here, spool valve inner sleeve 147 has an enlarged end 140 to compensate for any difference in areas against which the discharge pressure may be acting. The area differences could be between the upper cross sectional area of spool valve inner sleeve 147 plus the area of discharge pipe 7 and that of the annular area of under side of spool valve inner sleeve 147. Sliding seal 139 prevents compressed air from getting from one side of the enlarged end 140 to the other. The lower side of spool valve inner sleeve is referenced to the compressed air supply pressure via conduit 142. This balances the downward discharge pressure exerted by the fluid on the upper area of spool valve inner sleeve 147 and discharge pipe 7. The upper side of the enlarged end 140 is connected to the exhaust conduit 149 via conduit 144. This allows spool valve inner sleeve 147 to shift easily by allowing any gas on the upper side of enlarged end 140 to escape or enter easily. Conduit 144 can be drilled into spool valve outer sleeve 145 at an angle not to intersect with conduit 152 and then continued upwards and over into conduit 149 near the upper end of outer spool valve sleeve 145. FIG. 9 shows this in schematic form by drawing conduit 144 looping around conduit 152.

With regard to the actuation of either the compressed air inlet valve or the air outlet valve, the reader will understand that the illustrated actuation mechanisms are exemplary. Other actuations can be used. For example, increased air pressure in the buoyant casing can operate an air solenoid type valve to outlet air from the buoyant casing.

The advantages of this system over prior art systems is that the pump can continue to function even though debris may build up inside the pump. Also it can function without stuttering due to rapid flux of fluid into or out of the pump. In addition, this pump provides an advance in the state of the art in that, aside from the check valves, has only one moving part in the fluid being pumped and it is totally automatic.

Further, this system is powered by compressed air which eliminates the sparking hazards of electrically powered pumps. Thus it is seen that the present system provides a novel, lightweight, economical, highly reliable, pumping mechanism which can be easily manufactured, installed, used and removed by persons with a minimal amount of knowledge in the field of pumping fluids. The present system has the capacity to save expense in maintenance of pumps and work time lost due to electrical shock injuries from electrical sump and well pumps.

While the above description contains many specificities, the reader should not construe these limitations on the scope of the invention, but merely as exemplifications of preferred embodiments thereof. Those skilled in the art will envision many other possible variations are within its scope. Some of these variations will include the shape of the pump; the check valves being flap, disk or other design; the air valves being different shape; the detent mechanism being other than magnetic (e.g. constructed of an automatic resetting mechanical interference system); the pump mechanisms lack devices being constructed on components than the air valves; the air and fluid valves being more numerous; having more than one discharge pipe; the buoyancy spring being a different mechanism (e.g. magnetic) or having more than one spring; the spool valve being elsewhere than surrounding the discharge pipe; the flexible air conduits being able to flex without being tubing (e.g. sliding seals).

Accordingly the reader is requested to determine the scope of the invention by the appended claims and their legal equivalents, and not by the examples which have been given.

What is claimed is:

1. An apparatus for pumping fluids utilizing a compressed gas power source comprising:

an enclosed buoyant casing having (1) a top, a bottom, and at least one side for defining an interior volume for pumping fluids, (2) a positive buoyancy with respect to the fluids to be pumped when the interior volume is at least partially empty of fluids to be pumped, and (3) a negative buoyancy with respect to fluids to be pumped when the interior volume is at least partially flooded with fluids to be pumped;

means for mounting said enclosed buoyant casing for sliding sealed movement with respect to a discharge pipe between an upper position and a lower position;

an outlet to said discharge pipe located inside and below the top of said enclosed buoyant casing;

means for allowing fluid out said discharge pipe but not back in;

an inlet to said enclosed buoyant casing having means for allowing fluid into said enclosed buoyant casing but not out;

an air exhaust valve communicating proximate to an upper portion of said enclosed buoyant casing, said valve having an open position and a closed position;

a compressed air inlet valve communicating to said enclosed buoyant casing, said valve having a closed position and an open position; and means for actuating said air exhaust valve and said compressed air inlet valve for opening said air exhaust valve and for closing said air inlet valve when said enclosed buoyant casing is in said upper position and for closing said air exhaust valve and opening said compressed air inlet valve when said enclosed buoyant casing is in said lower position.

2. The apparatus of claim 1 wherein said means for actuating said air exhaust valve and said compressed air inlet valve includes a support arm for attachment to said discharge pipe at one end and actuating said air exhaust valve and said compressed air inlet valve at another end.

3. The apparatus of claim 1 further including detent means for effecting positive movement of said enclosed buoyant casing with respect to said discharge pipe including a detent member and a detent receiving member, one of said members being attached to said discharge pipe and a second of said members being attached to said enclosed buoyant casing for movement towards and away from contact between said detent member and said detent receiving member during movement of said enclosed buoyant casing relative to said discharge pipe.

4. The apparatus of claim 3 wherein said detent means includes a magnet member and a member attracting said magnet member.

5. The apparatus of claim 1 further including means for mounting said enclosed buoyant casing for sliding sealed movement with respect to said discharge pipe between said upper position and said lower position.

6. The apparatus of claim 1 wherein said means for mounting said enclosed buoyant casing for sliding sealed movement with respect to said discharge pipe includes at least one diaphragm having a first portion mounted to said discharge pipe and a second portion mounted to said enclosed buoyant casing.

7. The apparatus of claim 1 wherein said inlet to said enclosed buoyant casing is at said bottom of said enclosed buoyant casing.

8. The apparatus of claim 1 wherein said inlet to said enclosed buoyant casing is at said top of said enclosed buoyant casing.

9. The apparatus of claim 1 wherein said inlet to said enclosed buoyant casing communicates to said discharge pipe.

10. The apparatus of claim 1 further including means for adjusting the buoyancy of said enclosed buoyant casing with respect to said discharge pipe.

11. The apparatus of claim 10 further including spring means having a first end attached to said discharge pipe and a second end attached to said buoyant casing for exerting a bias between said first end and said second end.

12. The apparatus of claim 1 wherein said air exhaust valve and said compressed air inlet valve are contained outside said enclosed buoyant casing.

13. The apparatus of claim 1 wherein said air exhaust valve and said compressed air inlet valve are contained in relatively moving concentric spools.

14. The apparatus of claim 13 further including one of said spools attached to the discharge pipe and the other of said spools to the buoyant casing.

15. The apparatus of claim 14 wherein said spools are both outside said enclosed buoyant casing.

16. Apparatus in combination for pumping of fluid from a body of fluid comprising in combination;

(a) a discharge pipe;

(b) said discharge pipe having an opening;

(c) a compressed gas power source;

(d) an enclosed buoyant casing having (1) a top, a bottom, and at least one side for defining an interior volume for pumping fluids, (2) a positive buoyancy with respect to the fluids to be pumped when the interior volume is at least partially empty of fluids to be pumped, and (3) a negative buoyancy with respect to fluids to be pumped when the interior volume is at least partially flooded with fluids to be pumped;

means for mounting said enclosed buoyant casing for sliding movement with respect to said discharge pipe between an upper position and a lower position;

an outlet to said discharge pipe located inside and below the top of said enclosed buoyant casing;

means for allowing fluid out said discharge pipe but not back in the enclosed buoyant casing from said discharge pipe;

an inlet to said enclosed buoyant casing having means to allow fluid in and not out;

an air exhaust valve to discharge air from an upper portion of said enclosed buoyant casing, said air exhaust valve having an open position and a closed position;

a compressed air inlet valve communicated to the enclosed buoyant casing having a closed position and an open position; and means for actuating said air exhaust valve to open and said compressed air inlet valve to close when said buoyant casing is in said upper position and said air exhaust valve to close and said compressed air inlet valve to open when said buoyant casing is in said lower position.

17. The apparatus of claim 16 further including means for actuating said air exhaust valve and said compressed air inlet valve including a support arm for attachment to said discharge pipe at one end and said valves at the another end.

18. The apparatus of claim 16 further including detent means for effecting positive movement of said enclosed buoyant casing with respect to said discharge pipe including a detent member and a detent receiving member, one of said members being attached to said discharge pipe and a second of said members being attached to said buoyant casing for movement towards and away from contact between said detent member and said detent receiving member during movement of said enclosed buoyant casing on said discharge pipe.

19. The apparatus of claim 18 wherein said detent means includes a magnet member and a member attracting said magnet member.

20. The apparatus of claim 16 wherein said means for mounting said enclosed buoyant casing for sliding sealed movement with respect to said discharge pipe includes at least one diaphragm having a first portion mounted to said discharge pipe and a second portion mounted to said enclosed buoyant casing.

21. The apparatus of claim 16 wherein said inlet to said enclosed buoyant casing is at said bottom of said enclosed buoyant casing.

22. The apparatus of claim 16 wherein said inlet to said enclosed buoyant casing is at said top of said enclosed buoyant casing.

23. The apparatus of claim 16 wherein said inlet to said enclosed buoyant casing communicates to said discharge pipe.

24. The apparatus of claim 16 further including means for adjusting the buoyancy of said enclosed buoyant casing with respect to said discharge pipe.

25. The apparatus of claim 24 further including spring means having a first end attached to said discharge pipe and a second end attached to said buoyant casing for exerting a bias between said first end and said second end.

26. The apparatus of claim 16 wherein said air exhaust valve and said compressed air inlet valve are contained in relatively moving concentric spools.

27. The apparatus of claim 26 further including attaching one spool to the discharge pipe and the spool to the casing.

28. The apparatus of claim 27 wherein said spool attached to said discharge pipe and said spool attached to said enclosed buoyant casing are both outside said enclosed buoyant casing.

* * * * *